United States Patent [19]

Horvath et al.

[11] Patent Number: 4,890,868

[45] Date of Patent: Jan. 2, 1990

[54] DOOR LATCH

[76] Inventors: Edward Horvath, 1737 Libby Pl., Bronx, N.Y. 10461; George Spector, 233 Broadway, Ste. 3815, New York, N.Y. 10007

[21] Appl. No.: 330,780

[22] Filed: Mar. 30, 1989

[51] Int. Cl.[4] ..... E05C 5/00

[52] U.S. Cl. ..... 292/67; 292/346; 292/DIG. 25; 292/DIG. 72; 292/336.3

[58] Field of Search ..... 292/57, 63, 66, 67, 292/69, 336.3, DIG. 25, DIG. 18, DIG. 72, 346

[56] References Cited

U.S. PATENT DOCUMENTS

| | | | |
|---|---|---|---|
| 223,624 | 1/1880 | DeWitt | 292/57 |
| 401,574 | 4/1889 | Murphy | 292/57 |
| 446,997 | 2/1891 | Stroh et al. | 292/DIG. 18 X |
| 703,372 | 7/1902 | Beisel | 292/DIG. 18 X |
| 1,062,110 | 5/1913 | Moore | 292/66 |
| 1,356,479 | 10/1920 | Werner | 292/DIG. 18 X |
| 1,700,557 | 1/1929 | Cherniack et al. | 292/DIG. 18 X |
| 1,811,575 | 6/1931 | Broadwater | 292/DIG. 12 X |
| 4,666,195 | 5/1987 | Thomas, III | 292/336.3 X |

FOREIGN PATENT DOCUMENTS

| | | | |
|---|---|---|---|
| 419549 | 10/1925 | Fed. Rep. of Germany | 292/57 |

*Primary Examiner*—Gary L. Smith
*Assistant Examiner*—Michael J. Milano

[57] ABSTRACT

A safety door latch is provided for a door hinged to a door frame in a building having a first and second floor. The door latch is spring biased closed to keep the door in a secured locked position and can be manually released to unlock the door from the first and second floors.

4 Claims, 1 Drawing Sheet

DOOR LATCH

BACKGROUND OF THE INVENTION

The instant invention relates generally to fastening devices and more specifically it relates to a safety door latch.

Numerous fastening devices have been provided in prior art that are adapted to holding doors and shutters in secured positions. For example, U.S. Pat. Nos. 214,126; 1,709,915; 3,317,231 and 4,666,195 all are illustrative of such prior art. While these units may be suitable for the particular purpose to which they address, they would not be as suitable for the purposes of the present invention as heretofore described.

SUMMARY OF THE INVENTION

A primary object of the present invention is to provide a safety door latch that will overcome the shortcomings of the prior art devices.

Another object is to provide a safety door latch which will keep the door in a secured locked position and will permit the unlocking of the door from the first and second floors.

An additional object is to provide a safety door latch that will prevent unauthorized entry through a doorway without utilizing electronic devices.

A further object is to provide a safety door latch that is simple and easy to use.

A still further object is to provide a safety door latch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 1:
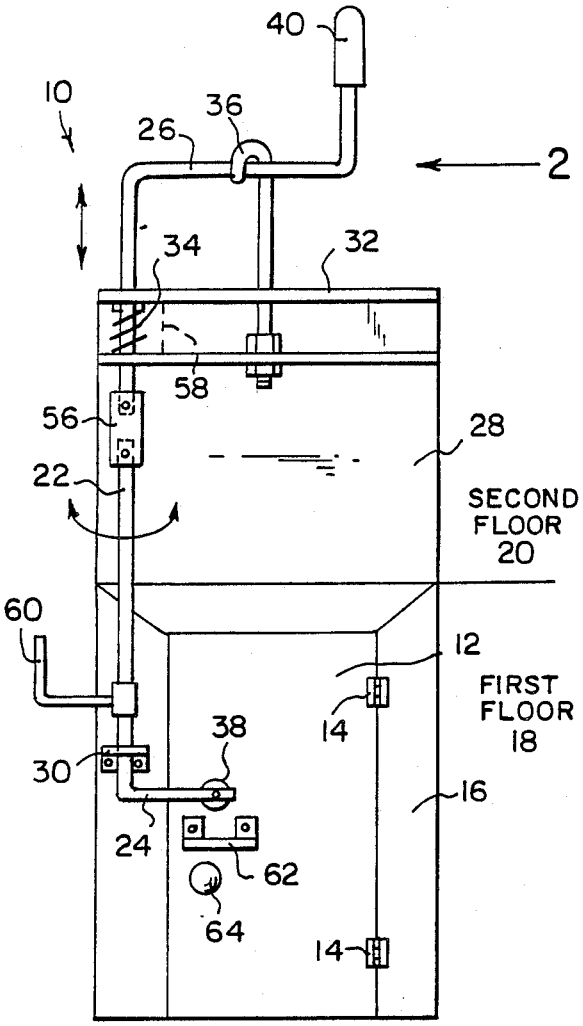
FIG. 1 is a front elevational view of a first form of the invention.
Figure 2:
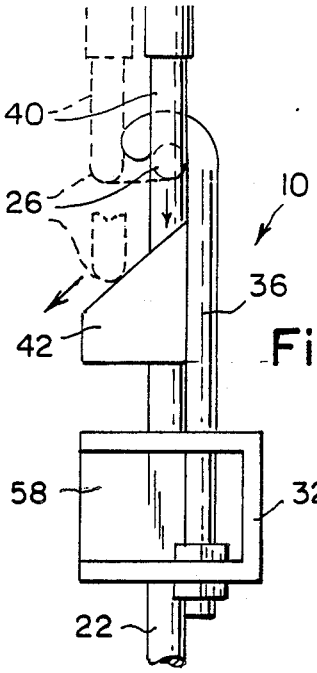
FIG. 2 is a side view taken in direction of arrow 2 in FIG. 1 with parts broken away showing a modification in which a cam on the hook member will automatically cause the upper arm to turn when handle is pressed downwardly to release the lower arm away form the door.
Figure 3:
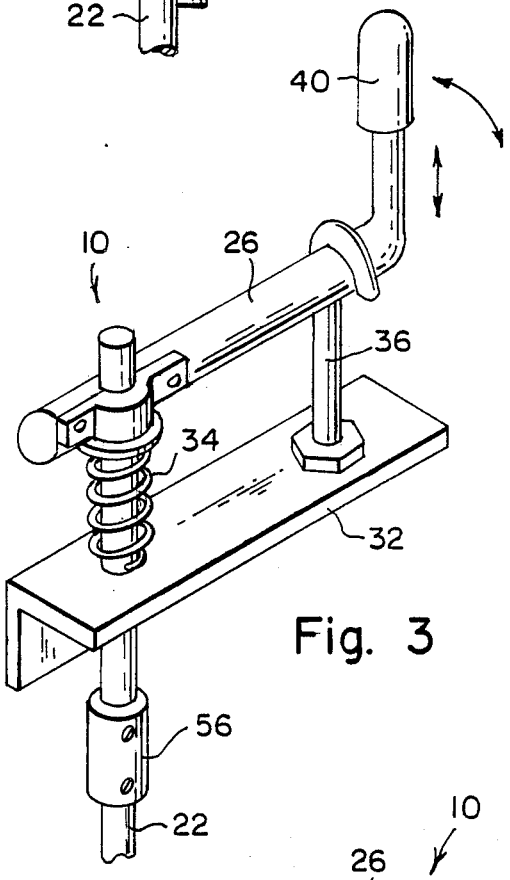
Figure 4:
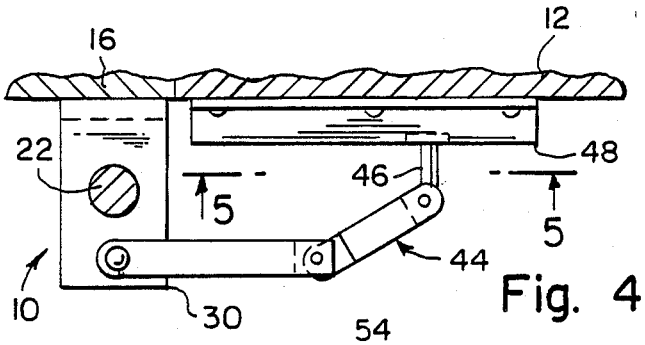

FIG. 3 is a perspective view of upper portion of a second form of the invention in which an upper L-channel bracket is utilized instead of a C-shaped channel bracket of FIGS. 1 and 2 wherein the return spring is mounted in top of the upper bracket FIG. 4 is a top view of lower portion of the second form of the invention in which a security member with door bracket are utilized so that the door can be partly opened.

Figure 5:
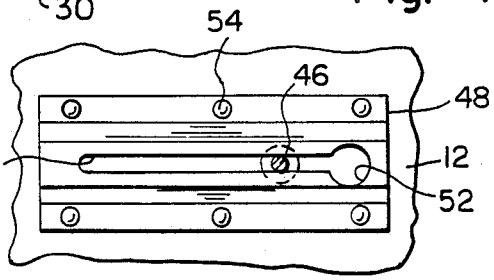

FIG. 5 is a cross sectional view taken along line 5—5 in FIG. 4, showing slot within the door bracket in greater detail.

Figure 6:
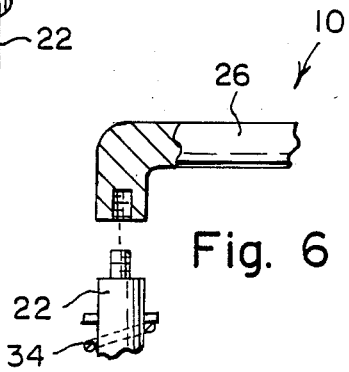

FIG. 6 is an exploded elevational view with parts broken and in section of another modification in which the upper arm is threaded onto the rod for easy assembly thereon of the spring.

DETAILED DESCRIPTION OF THE PREFERRED EMBODIMENTS

Turning now descriptively to the drawings, in which similar reference characters denote similar elements throughout the several views, the figures illustrate a safety door latch 10 for a door 12 hinged at 14 to a door frame 16 in a building having a first floor 18 and a second floor 20. The latch 10 contains an elongated vertically disposed C-shaped rod 22 having a lower horizontal arm 24 and an upper horizontal arm 26. The rod 22 extends from the door frame 16 opposite the hinges 14 on the first floor 18 up along a wall 28 onto the second floor 28. A lower bracket 30 is mounted to the door frame 16 for supporting the rod 22 for rotation about the vertical axis of the rod and allowing the rod 22 to shift upwardly and downwardly. An upper bracket 32 is mounted to the second floor wall 28 for supporting the rod 22 for rotation about the vertical axis of the rod and allowing the rod 22 to shift upwardly and downwardly.

A spring 34 is mounted on the rod 22 adjacent the upper bracket 32 for biasing the rod upwardly. A hook member 36 is affixed to the upper bracket 32 to capture and hold the upper arm 26. An adjustable wheel 38 is carried on free end of the lower arm 24 to face away and bear against the door 12. A handle 40 extends at right angle up from the upper arm 26 so as to be manually pressed downwardly to release the upper arm 26 from the hook member 36 to open the door latch 10.

As shown in FIG. 2, a cam 42 can be carried on the hook member 36 which will automatically cause the upper arm 26 to turn when the handle 40 is pressed downwardly to release the lower arm 24 away from the door 12 so that the door can be opened.

As shown in FIGS. 3 and 6, the upper horizontal arm 26 is removably attached to rest of the rod 22 so that the spring 34 can be easily assembled thereon.

FIGS. 4 and 5 show a pivotly segmented security member 44 carried at one end on the lower bracket 30. The security member 44 has a locking pin 46 extending from an opposite end thereof. A door bracket 48 having a slot 50 with an enlarged aperture 52 at one side is secured to the door 12 by rivets 54 or the like. The enlarged aperture 52 is positioned away from the lower bracket 3 so that the locking pin 46 can ride within the slot 50 to allow the door 12 to be partly opened and still be secured.

A connector 56 can be provided to split and adjust the rod 22 for proper assembly. A cover 58 as shown in FIGS. 1 and 2 can be utilized to hide and protect the spring 34. An auxiliary handle 60 can be connected to lower portion of the rod 22 to facilitate operation of the door latch 10 from the first floor 18. A shield 62 can be secured to the door 12 between door knob 64 and the lower arm 24 to prevent access to the door latch 10 by removing the door knob 64.

To open th door 12 one simply pushes the rod 22 downwardly so that the upper arm 26 can be released from the hook member 36 and then be rotated so that lower arm 24 moves away from the door 12 allowing the door to be opened. To secure the door 12 just release the operation as described above.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety door latch for a door hinged to a door frame in a building having a first and second floor, said latch comprising:

(a) an elongated vertically disposed C-shaped rod having a lower horizontal arm and an upper horizontal arm, said rod extending from the door frame opposite the hinged portion of the door on the first floor up along a wall onto the second floor;

(b) a lower bracket mounted to the door frame for supporting said rod for rotation about the vertical axis of said rod and allowing said rod to shift upwardly and downwardly (c) an upper bracket mounted to the second floor wall for supporting said rod for rotation about the vertical axis of said rod and allowing said rod to shift upwardly and downwardly;

(d) a spring mounted on said rod adjacent said upper bracket for biasing said rod upwardly;

(e) a hook member affixed to said upper bracket to capture and hold said upper arm;

(f) an adjustable wheel carried on free end of said lower arm to face away and bear against the door; and (g) a handle extending at right angle up from said upper arm so as to be manually pressed downwardly to release said upper arm from said hook member to open said door latch.

2. A safety door latch as recited in claim 1, further comprising a cam carried on said hook member which will automatically cause said upper arm to turn when said handle is pressed downwardly to release said lower arm away from the door so that the door can be opened.

3. A safety door latch as recited in claim 2, wherein said upper horizontal arm is removably attached to rest of said rod so that said spring can be easily assembled thereon.

4. A safety door latch as recited in claim 3, further comprising:

(a) a pivotly segmented security member carried at one end on said lower bracket, said security member having a locking pin extending from opposite end thereof; and (b) a door bracket having a slot with enlarged aperture at one side secured to the door in such a way that the enlarged aperture is positioned away from said lower bracket so that said locking pin can ride within said slot to allow the door to be partly opened and still be secured.

* * * * *